US005690241A

United States Patent [19]

Montgomery

[11] Patent Number: 5,690,241

[45] Date of Patent: Nov. 25, 1997

[54] THREAD ON-NON-REMOVABLE CAP FOR A THREADED NECK CONTAINER

[75] Inventor: Gary V. Montgomery, Evansville, Ind.

[73] Assignee: Rexam Closures, Inc., Evansville, Ind.

[21] Appl. No.: 710,664

[22] Filed: Sep. 18, 1996

[51] Int. Cl.[6] ..... B65D 41/04

[52] U.S. Cl. ..... 215/28; 215/263; 215/330; 215/235; 222/556

[58] Field of Search ..... 215/28, 44, 235, 215/263, 330, 344, 14, DIG. 1; 220/289, 86.4; 222/556, 517

[56] References Cited

U.S. PATENT DOCUMENTS

| | | | |
|---|---|---|---|
| 2,423,582 | 7/1947 | Coleman | 215/330 X |
| 3,435,978 | 4/1969 | Wittwer | 215/330 X |
| 3,927,783 | 12/1975 | Bogert . | |
| 4,093,096 | 6/1978 | Augros . | |
| 4,494,665 | 1/1985 | Lehamnn . | |
| 4,557,394 | 12/1985 | Luker . | |
| 4,662,530 | 5/1987 | Goncalves et al. . | |
| 4,770,308 | 9/1988 | Lynn . | |
| 4,998,989 | 3/1991 | Curiel | 215/230 X |
| 5,096,077 | 3/1992 | Odet et al. | 215/263 X |
| 5,145,080 | 9/1992 | Imberry, Jr. | 215/330 X |
| 5,161,707 | 11/1992 | Dutt et al. | 215/344 |
| 5,205,424 | 4/1993 | Gaspar | 215/263 X |
| 5,292,020 | 3/1994 | Narin . | |
| 5,297,688 | 3/1994 | Beck et al. | 215/344 |
| 5,494,174 | 2/1996 | Rohr et al. . | |

*Primary Examiner*—Allan N. Shoap
*Assistant Examiner*—Nathan Newhouse
*Attorney, Agent, or Firm*—Gifford, Krass, Groh, Sprinkle, Patmore, Anderson & Citkowski, P.C.

[57] ABSTRACT

A removal resistant closure cap for a container having a standard threaded neck is disclosed. The cap does not have a thread complementary to the container neck thread but has an inwardly projecting circumferential bead with an intersecting projection extending downwardly from the bead at the helix angle of the container neck thread. When the container neck is engaged by the cap with a threading rotation, the cap projection will engage the container neck thread, and the cap bead will snap over the container neck thread, permanently retaining in the cap on the container neck.

6 Claims, 2 Drawing Sheets

THREAD ON-NON-REMOVABLE CAP FOR A THREADED NECK CONTAINER

BACKGROUND OF THE INVENTION

I. Field of the Invention

This invention relates to a closure, and, more particularly, this invention relates to a removal resistant closure cap for a container having a standard threaded neck.

II. State of the Art

Commonly containers have threaded necks which are designed to receive a threaded closure cap. Many of the threaded closures are provided with a dispensing feature. Typically the base of the closure which carries the internal threads has a dispensing orifice in its top. Normally, a lid is hinged to the base with a lid carrying a plug to seal the dispensing orifice when the lid is in its closed position. In the open position, dispensing of the product can take place through the orifice, and in most cases it is desirable that the cap be not removable from the container.

Typically, to make the dispensing closure non-removable from the container, cooperating stop means must be molded on both the container neck and on the closure. For example, U.S. Pat. No. 4,747,498 shows a threaded dispensing closure in which ratchet teeth are molded on the lip of the container neck, and cooperating ratchet teeth are molded in an annular array on the inside of the cap top. When the cap is tightened onto the container neck, the cooperating ratchet teeth engage to prevent removal of the cap. In U.S. Pat. No. 4,727,999 another dispensing cap is shown in which the base of the cap has an inwardly projecting bead which coacts with a groove on the container neck so that when the cap is fully threaded onto the container neck, the bead engages within the groove to prevent removal of the cap. Since the cap is applied to the container neck by automatic capping machinery after the container has been initially filled with product, the ultimate consumer is usually unaware of the mechanism by which the cap is permanently retained on the container neck.

In other instances, the ultimate consumer can be the person which initially seals the container closure package. For example in the disposal of hazardous materials, a container with a threaded neck might be provided along with a threaded cap. The ultimate user applies the cap to the container neck knowing that the container will seal in its closed position and the cap cannot be removed. As in the dispensing closure, the mechanism for retaining the cap on the container neck may require suitable cooperating stop means molded on both the container neck and on the closure.

SUMMARY OF THE INVENTION

In the present invention, the closure is molded so that it will engage a standard container neck thread to tighten on the container neck in sealing relationship. Once the closure has been engaged on the container neck, it cannot be removed by unthreading. The closure of the invention does not require a separately molded stop or locking device on the cap and the container neck to effect the permanent attachment of the closure to the container neck.

The closure cap of the invention includes a top and a cylindrical skirt that depends from the periphery of the top. The skirt has an inwardly projecting continuous circumferential bead with an inside diameter having a close fit with the container neck and with the bead being located below the top a distance greater than the axial extent of the container thread. A linear projection on the skirt intersects the bead and extends downwardly from the bead at the helix angle of the container thread. A rotary seal is provided between the closure and the container neck so that a sealing relationship is maintained between the cap and the container neck even though the cap may be rotated relative to the container neck. When the container neck is engaged by the cap in a threading manner, the projection will engage the container neck thread and displace the bead of the closure over the container neck thread so that the closure is axially aligned with the container neck and is in sealing relationship with the container neck. The seal can take the form of an internal plug which engages the internal container neck surface or the seal can be in the form of a shoulder or an inwardly projecting bead on the cap skirt adjacent or at the intersection of the cap top and cap skirt which engages an external surface of the container neck. Alternatively the seal can be in the form of a resilient gasket which is compressed between the lip of the container neck and the cap top. The cap can be in the form of a dispensing closure having a dispensing orifice in the top, or the closure can have an imperforate planar top to permanently seal the container contents.

DRAWING

The advantages of the present invention will be more apparent from the following detailed description when considered in connection with the accompanying drawing wherein.

DETAILED DESCRIPTION

Figure 1:
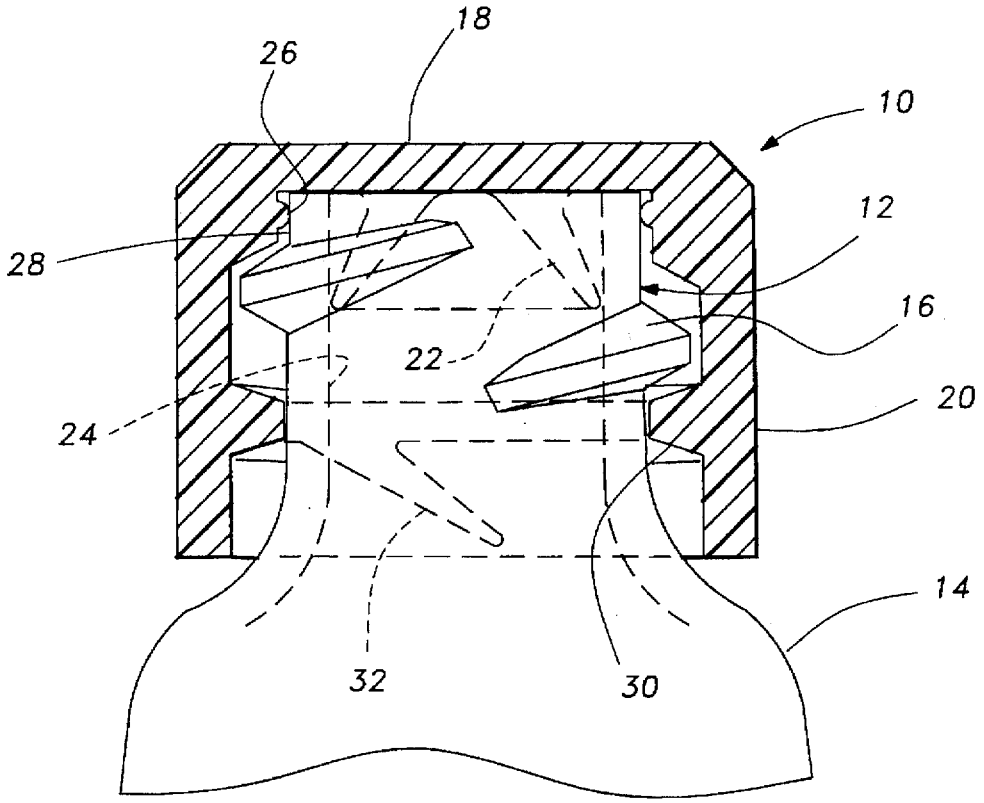
FIG. 1 is an elevational view, partially in section, of the closure cap of the invention applied to a threaded container neck.
Figure 2:
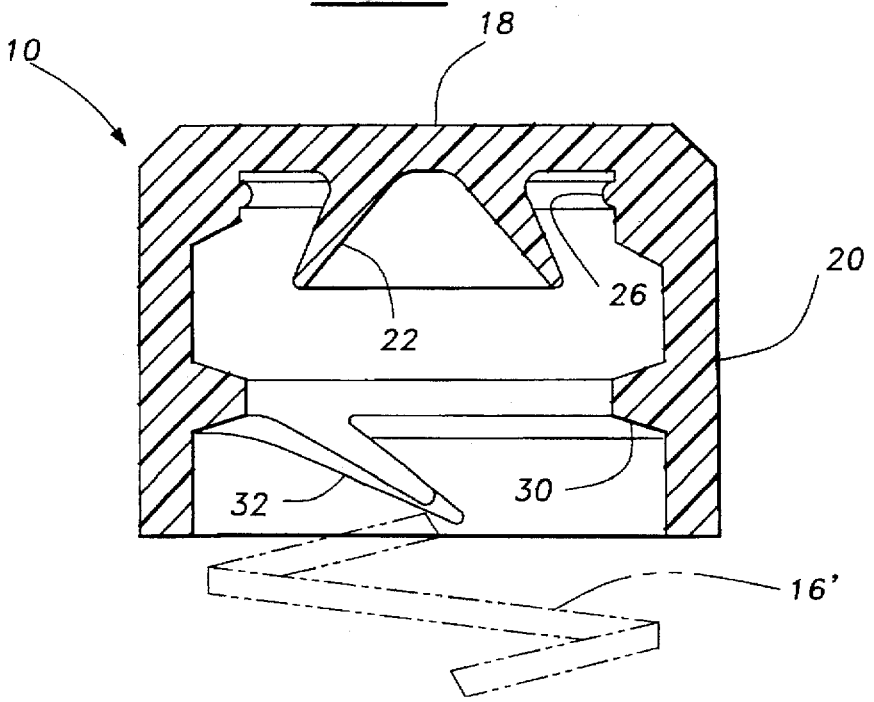
FIG. 2 is a cross-sectioned elevational view of the closure of FIG. 1 showing a rotary plug seal.

Referring to FIGS. 1 and 2, the closure 10 of this invention is a single piece cap which is shown applied to the neck 12 of a container 14. The container has a standard helical thread 16 designed to receive a cap with a complementary standard helical thread for threading the cap onto and off the container neck. The cap 10 does not have a standard thread, but it is rather designed to be applied to the container neck in a non-removable or permanent fashion. The cap 10 has a planar top 18 with an annular cap skirt 20 depending from the periphery of the top. The cap has an outwardly tapering plug 22 depending from the cap top 18 which forms a rotary seal with the inside diameter 24 of the container neck. The cap skirt 20 also has an inwardly projecting continuous circumferential bead 26 adjacent the cap top 18 which forms a rotary seal with the external neck surface 28 above the thread 16. It will be appreciated that either the external seal 26 or the internal seal 22 may be omitted with sealing accomplished by just one or the other of these seals.

The cap 10 has an inwardly projecting circumferential bead 30 with an inside diameter having a close fit with the external neck surface and located below the axial extent of the container thread 16. A linear projection 32 on the inside of the cap skirt intersects the circumferential bead 30 and extends downwardly from the bead at approximately or generally the helix angle of the container thread.

When the container neck 12 is engaged by the cap 10 in a threading manner, the projection 32, acting as a thread tail, will engage the container neck thread 16 and displace the cap bead 30 over the container neck thread 16, leaving the cap 10 sealed and aligned with the container neck 12. Turning the cap in either direction will not disengage the cap, but the bottom of the container neck thread 16 will ride above the cap bead 30. The container 14 and the closure 10 are molded with a resilient plastic such as polypropolene so that one or both can yield as the circumferential closure bead 30 is snapped over the container neck thread 16.

In FIG. 2, the orientation of the container neck thread is shown in phantom at 16' relative to the cap structure 10.

Figure 3:
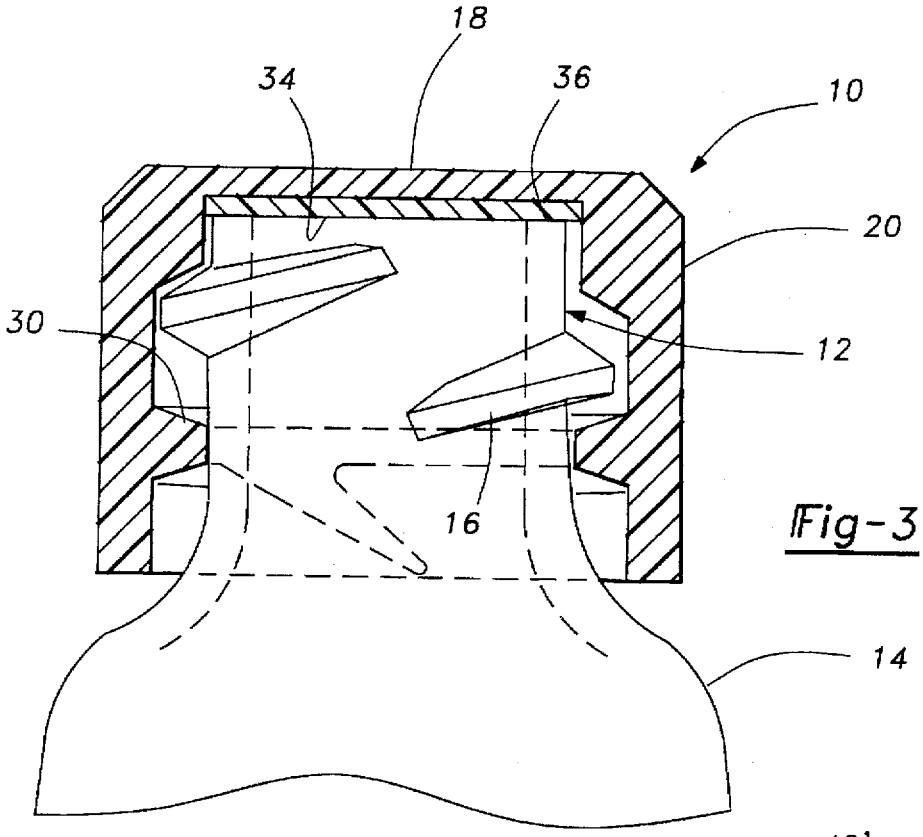
FIG. 3 is an elevational view, partially in section of the closure cap of the invention applied to a threaded container neck similar to FIG. 1 but showing a gasket type seal.

In FIG. 3, sealing of the container neck 12 and the closure 10 is obtained by the use of a resilient insert or gasket 34 which is compressed between the inside surface of the cap top 18 and the container neck lip 36 when the cap has been snapped onto the container neck 12.

Figure 4:
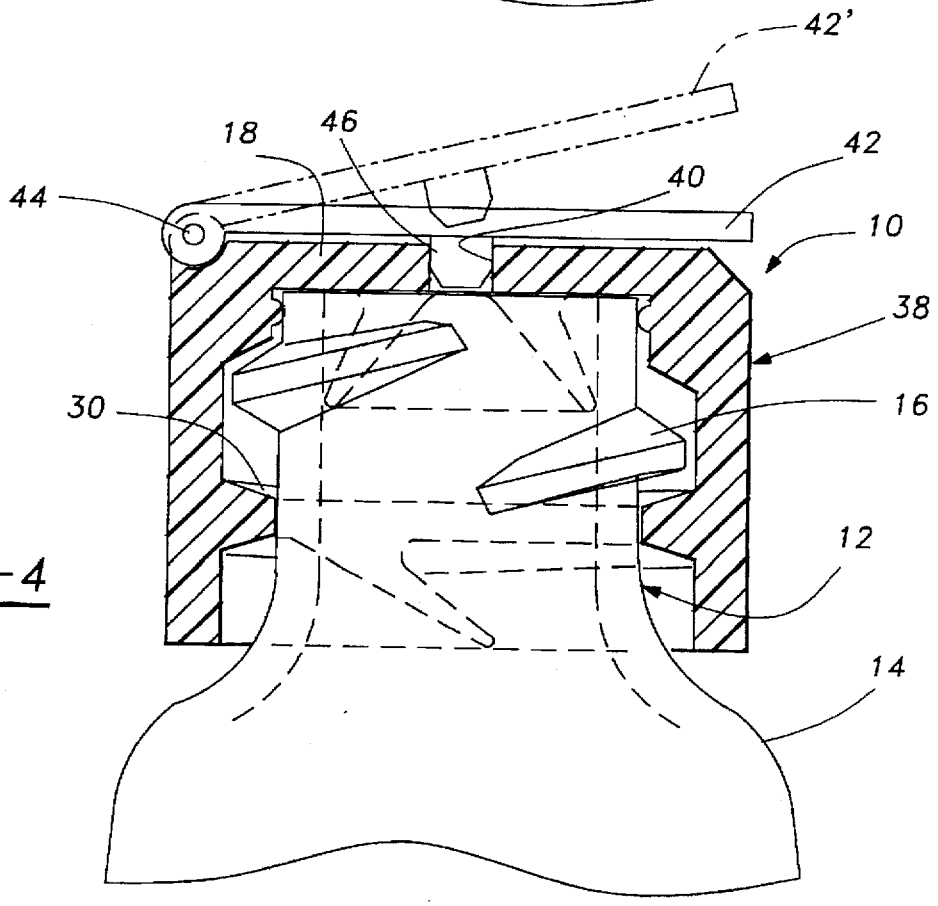
FIG. 4 is an elevational view, partially in section of the closure cap of the invention applied to a threaded container neck with the closure being a dispensing closure.

In the embodiment of FIG. 4, the cap 10 is shown as a dispensing cap having a base 38 incorporating all of the same features as the cap 10 of FIGS. 1–3, but additionally having a dispensing orifice 40 in the cap top 18. A lid 42 is attached to the base 38 with a hinge 44. The lid has a plug 46 which in the closed position of the cap engages and seals the dispensing orifice 40. When the lid 42 is swung to a dispensing position, the plug 46 disengages the orifice 40 as indicated in the partially opened position of the lid shown in phantom at 42'.

If the container neck has multiple threads, the closure will be formed with a corresponding number of linear projections 32 which will intersect the container bead 30.

I claim:

1. A removal resistant cap and container assembly comprising:

a container having a threaded neck with said thread having a helix angle; a cap having a top and a cylindrical skirt depending from the periphery of said top;

said skirt having an inwardly projecting circumferential bead with an inside diameter having a close fit with said container neck, and said bead being located below said top a distance greater than the axial extent of said container thread;

a linear projection on said skirt intersecting said bead and extending downwardly from said bead generally at the helix angle of said container thread; and a rotary seal between said closure and said container neck;

wherein when said container neck is engaged by said cap in a threading manner, said projection will engage said container neck thread and displace said bead over said container neck thread, so said cap is axially aligned and in sealing relationship with said container neck and wherein said cap is blocked from threaded removal by said container neck thread engaging with said circumferential bead.

2. The assembly according to claim 1 wherein said rotary seal includes a plug projecting downwardly from said cap top to engage an internal surface of said container neck.

3. The assembly according to claim 1 wherein said seal is effected between said cap skirt and an external surface of said container neck above said neck thread.

4. The assembly according to claim 3 wherein said seal includes an inwardly projecting bead on said cap skirt.

5. The assembly according to claim 1 wherein said seal includes a resilient gasket which is compressed between a lip of said container neck and said cap top.

6. The assembly according to claim 1 wherein said top has a dispensing orifice, and said cap further includes a lid hinged to said cap and movable between a closed position sealing said dispensing orifice and an open position for dispensing product through said orifice.

* * * * *